United States Patent [19]

Kaulfuss et al.

[11] 4,239,825

[45] Dec. 16, 1980

[54] BIRD ORNAMENT

[75] Inventors: William P. Kaulfuss, Wilmette; Robert H. Kaulfuss, Northbrook, both of Ill.

[73] Assignee: Kaulfuss Designers Incorporated, Chicago, Ill.

[21] Appl. No.: 970,354

[22] Filed: Dec. 18, 1978

[51] Int. Cl.[2] ..... A63H 33/16; G09F 1/08

[52] U.S. Cl. ..... 428/16; 40/539; 46/1 L; 46/157; 428/43

[58] Field of Search ..... 428/16, 43, 7, 8, 9, 428/12, 121, 128; 46/1 H, 1 L, 124, 157; 40/539; 156/61

[56] References Cited

U.S. PATENT DOCUMENTS

| | | | |
|---|---|---|---|
| 2,168,384 | 8/1939 | Barry | 428/16 X |
| 2,256,584 | 9/1941 | Steeple | 428/16 X |
| 2,395,247 | 2/1946 | Buffenbarger | 46/157 |
| 3,386,196 | 6/1968 | Razzolini | 428/16 X |
| 3,419,995 | 1/1969 | Siegler | 46/124 |
| 3,440,747 | 4/1969 | Oliver | 428/43 X |
| 3,487,569 | 1/1970 | Mendall | 428/16 X |
| 4,084,015 | 4/1978 | Patterson | 428/43 X |

FOREIGN PATENT DOCUMENTS

| | | | |
|---|---|---|---|
| 1029270 | 3/1953 | France | 46/124 |

*Primary Examiner*—Henry F. Epstein
*Attorney, Agent, or Firm*—McDougall, Hersh & Scott

[57] ABSTRACT

Bird ornaments are provided on sheets of paper stock. The outline of the bird is die cut into the stock permitting easy removal from the sheet. Crease lines are provided to permit manual assembly of the ornament into a form resembling an existing specie of bird. A locking mechanism secures the bird in the assembled position. Holes are provided in the ornament for suspending it for display purposes.

4 Claims, 6 Drawing Figures

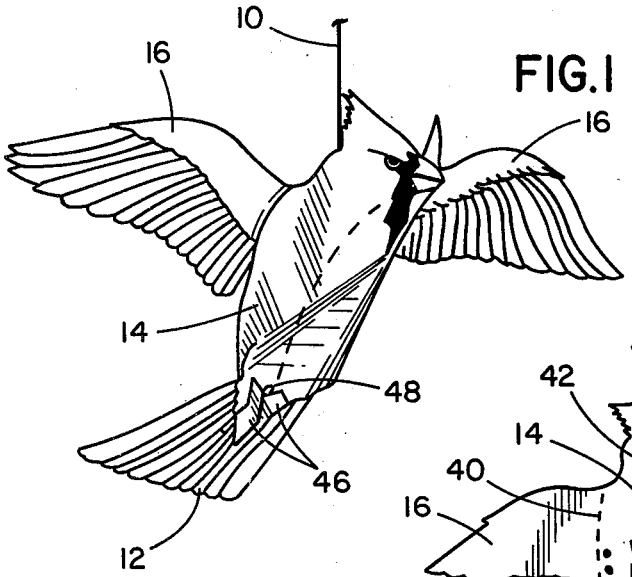
FIG.1
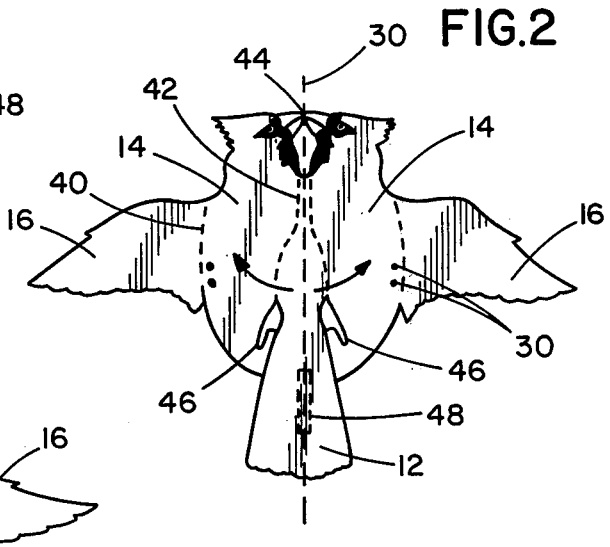
FIG.2
FIG.3
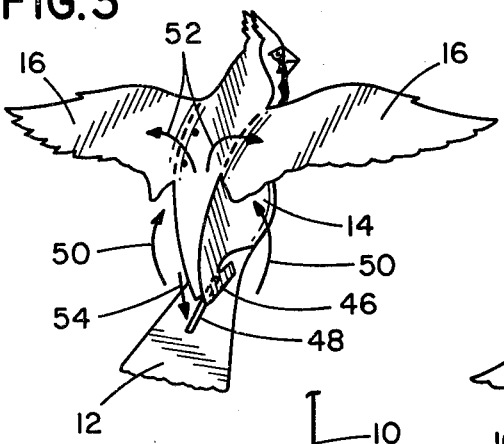
FIG.4
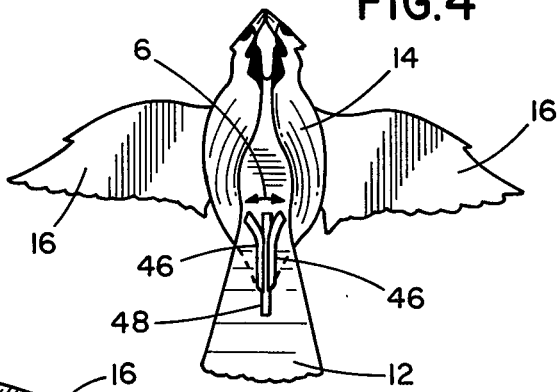
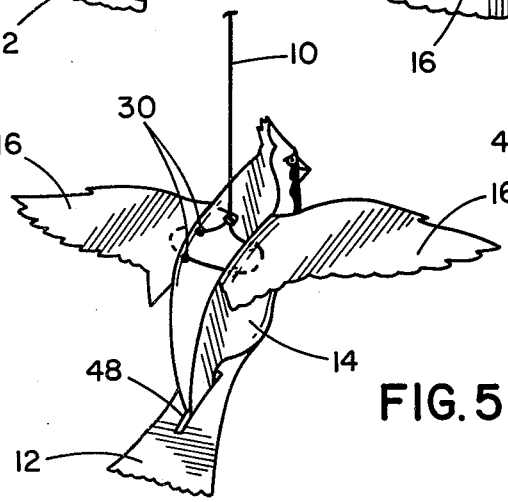
FIG.5

BIRD ORNAMENT

BACKGROUND OF THE INVENTION

This invention relates to ornaments and educational devices which may be used for decorative and teaching purposes. More specifically, it relates to inexpensive paper ornaments which can be punched out and readily assembled.

It has been known to provide various shapes on paper as, for example, paper dolls which can then be cut out with the use of scissors and pasted together, etc. However, often such cut outs were not realistic in their depiction of an animal or person. Further, this technique has been less than satisfactory with respect to certain animals due to their shapes. This is particularly true of birds.

It is accordingly an object of the present invention to provide low cost ornaments which accurately depict birds.

A further object of the invention is to provide manually assembled bird ornaments which accurately depict various species of birds whereby a teaching device is provided for use in conjunction with information about the particular species depicted.

A further object of the invention is to provide an attractive bird ornament which can be suspended from a ceiling to decorate or amuse children and adults.

Other objects and advantages of the invention will be apparent from the remaining portion of the specification.

BRIEF DESCRIPTION OF THE DRAWINGS

FIG. 1 is a perspective view of a bird ornament in its assembled position suspended by a line.

FIG. 2 is a plan view of the bird ornament blank after removal from the sheet stock on which it is supplied.

FIGS. 3 through 5 are drawings useful in understanding the method of assembly of the bird ornaments.

DETAILED DESCRIPTION

Figure 6:
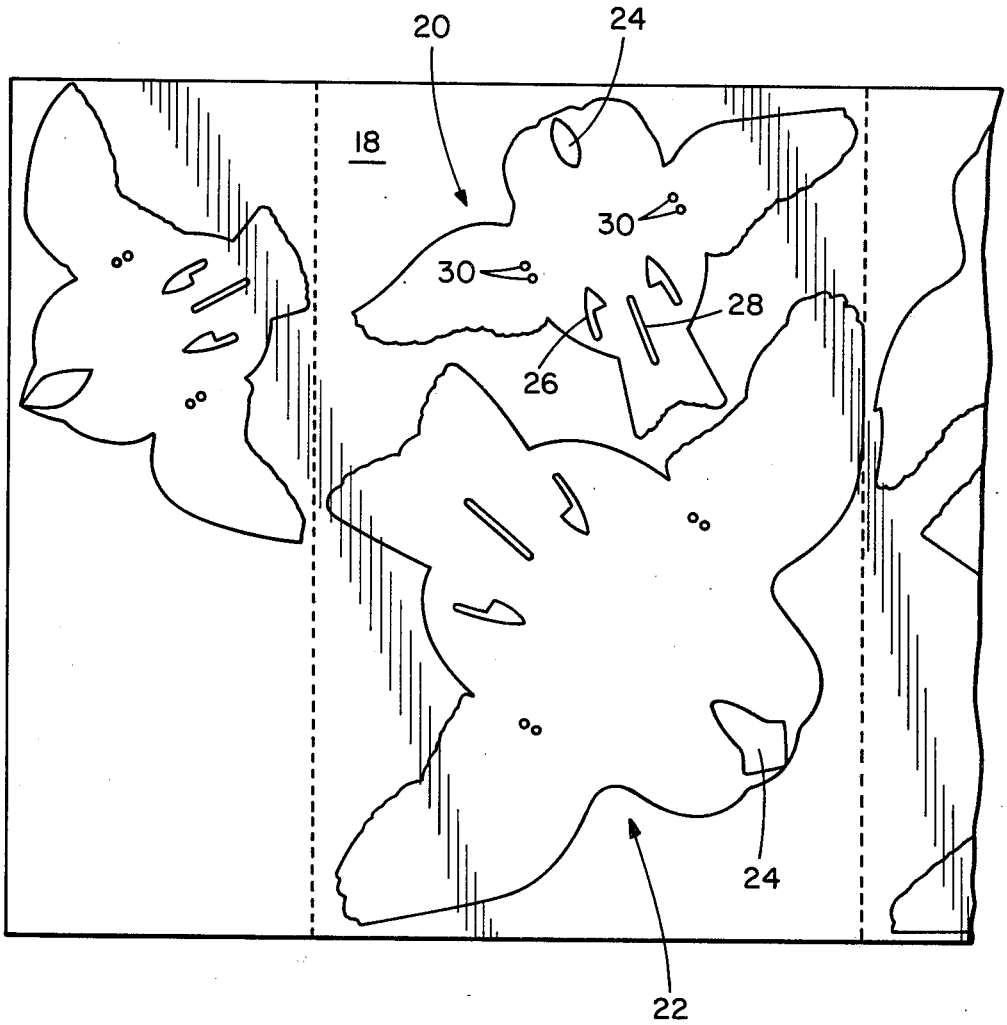
FIG. 6 is a plan view of the sheet stock showing the bird ornaments as supplied.

Referring to FIG. 1, a bird ornament according to the invention is illustrated. The ornament is suspended by a wire or string 10, preferably nylon, from a ceiling or other support. The ornament includes a tail portion 12, a pair of body portions 14 and a pair of wing portions 16. In its assembled form the ornament accurately depicts a selected bird specie.

Referring to FIG. 6, it will be observed that the bird ornaments are supplied on sheet stock 18 preferably of good quality paper. A plurality of bird ornaments may be provided on each sheet of stock as, for example, ornaments 20 and 22. The ornaments may be printed on the stock in black and white or, preferably, in color to provide an additional degree of realism to the ornaments in their assembled form. Thus, for example, the American Gold Finch 20 is printed with yellow and gray wings while the Evening Grosbeak 22 is provided with a few touches of yellow, black and white.

By providing plural ornaments on a single sheet of stock the cost of production is maintained low, an important consideration for an ornament of this type. In order to permit the user to remove the ornament from the stock the outer periphery of each ornament is die cut by conventional equipment utilized in the printing industry. In addition, various cuts are made internal to the ornament to provide for the removal of unnecessary portions of stock from the ornament. Thus, for example, the portion of stock 24 between the two views of the head is perforated for removal when assembling the ornament. Similarly, the sections 26 and the slot 28 are die cut for easy removal. At the same time that the die cuts are made in the stock, holes 30 are punched in the ornament body portion for a purpose to be described and score lines are formed in the stock to define the various portions of the ornament including the wing, body and tail portions.

From the foregoing description it will be apparent that the user receives the bird ornaments on paper stock and may readily remove each ornament from the stock by merely lifting the ornament therefrom, breaking any attaching bridges which exist where the die cut was not complete. An ornament blank, as illustrated in FIG. 2, is then available for assembly. The internal waste porions 24, 26 and 28 are rapidly removed from the blank and discarded when assembly is to begin.

Referring now to FIGS. 2 through 5, the ornament will be described in detail along with the steps necessary for its assembly. The ornament is symmetric about a vertical line 30 drawn through its middle and thus each half of the ornament is substantially a mirror reflection of the other half. The ornament includes wing portions 16, body portions 14 and the tail portion 12. A crease 40 defines the interface between each body portion and wing portion. Similarly, a crease line 42 defines the boundary of the body portion relative to the tail portion.

The body portion carries the head and beak of the bird and the beaks on each half of the ornament are joined at point 44 to maintain the head in its proper position in the assembled form. Provided on the bottom of the body portion are locking tabs 46 which are dimensioned to be received within the slot 48 formed when the stock portion 28 is removed therefrom.

To assemble the ornament illustrated in FIG. 2 the steps depicted in FIGS. 3 through 5 are followed in the following sequence. The body portions of the ornament are folded along the crease lines 42, as indicated in FIG. 3 by arrows 50. The wing portions 16 are then reversely folded along the crease lines 40 as indicated by arrows 52. The extent of the fold on the various crease lines depends to a large extent upon the particular specie of ornament being assembled. When these folds have been accomplished, the locking tabs 46 on the rear of the body portion will be positioned over the slot 48. In order to lock the bird in the desired position the tabs are manually inserted downwardly through the slot, as indicated by arrow 54. The tabs move forwardly in the slot tending to prevent any return to the unsecured position.

As illustrated in FIG. 4, in order to insure the locking of the tabs in the slot, it is desirable to bend or fold the tabs as illustrated by arrows 6 so as to eliminate the possibility of their slipping back through the slot. The tabs and slots thus secure the ornament in an assembled condition in which the two body portions 14 are approximately parallel to each other. The tail portion is then located therebeneath while the wing portions extend outwardly from the top of the body portions as illustrated in FIG. 1. This positioning substantially complies with what an observer would see when viewing a live bird from below and is both attractive and educational.

Depending upon the size and configuration of the species being reproduced, the crease line 40 may terminate at the rear portion thereof in an actual die cut portion to permit the wings to move away from the body portion to a more life-like position.

Referring to FIG. 5, the final assembly step is illustrated in which line 10, preferably of nylon string, is inserted through the holes 30 in the body portion in order to secure the ornament from a ceiling or other fixture. By drawing the line taut the upper extremities of the body portions are drawn together giving a realistic rounded appearance to the ornament. This appearance is maintained by use of four holes which prevent loosening of the line. These displays, when completed, particularly when a plurality of them are simultaneously displayed, are quite attractive and appealing and the assembly process is enjoyable for adults and children alike.

While we have shown and described embodiments of this invention in some detail, it will be understood that this description and illustrations are offered merely by way of example, and that the invention is to be limited in scope only by the appended claims.

We claim:

1. A manually assembled bird ornament comprising: a paper blank having a specie of bird printed thereon, said blank having a pair of body portions, a pair of wing portions and a tail portion, each of said portions being defined by a crease line in the blank, said body portions being intermediate said wing portions and said tail portion and carrying integral locking tabs thereon, said tail portion having a slot therein adapted to receive said tabs to accurately depict the bird in a lifelike position when the body portions are manually folded along a pair of said crease lines to positions wherein said body portions are substantially parallel to each other, said wing portions being folded outwardly and substantially perpendicular to said body portions when the body portions are brought into parallelism, and means carried on said body portions for suspending the ornament in said lifelike position from a fixture.

2. The manually assembled bird ornament according to claim 1 wherein each of said body portions carries a representation of the head of a bird, the body portions being joined together at the beak.

3. The manually assembled bird ornament according to claim 1 wherein said suspending means includes a pair of holes near the top of each of said body portions, and a flexible wire passing through said holes by which the ornament is suspended.

4. The manually assembled bird ornament according to claim 1 wherein said bird ornament is printed on paper stock and defined by die cuts in said stock and wherein at least two ornaments are provided are each sheet of stock.

* * * * *